US010981220B2

(12) United States Patent
Culp

(10) Patent No.: US 10,981,220 B2
(45) Date of Patent: Apr. 20, 2021

(54) HYBRID PART OVER-MOLDING PROCESS AND ASSEMBLY

(71) Applicant: Kevin Culp, Troy, MI (US)

(72) Inventor: Kevin Culp, Troy, MI (US)

(73) Assignee: Matcor-Matsu USA, Inc., Troy, MI (US)

( * ) Notice: Subject to any disclaimer, the term of this patent is extended or adjusted under 35 U.S.C. 154(b) by 97 days.

(21) Appl. No.: 15/684,227

(22) Filed: Aug. 23, 2017

(65) Prior Publication Data

US 2019/0060989 A1 Feb. 28, 2019

(51) Int. Cl.

| | |
|---|---|
| ***B22D 19/04*** | (2006.01) |
| ***B22D 19/00*** | (2006.01) |
| ***B22D 17/00*** | (2006.01) |
| ***B22D 17/22*** | (2006.01) |
| ***B22D 17/24*** | (2006.01) |
| ***B22D 21/00*** | (2006.01) |
| ***B22D 21/04*** | (2006.01) |

(52) U.S. Cl.

CPC ..... *B22D 19/00* (2013.01); *B22D 17/007* (2013.01); *B22D 17/2218* (2013.01); *B22D 17/2263* (2013.01); *B22D 17/24* (2013.01); *B22D 19/04* (2013.01); *B22D 21/007* (2013.01); *B22D 21/04* (2013.01)

(58) Field of Classification Search

CPC ..... B22D 19/00; B22D 19/04; B22D 17/2218
See application file for complete search history.

(56) References Cited

U.S. PATENT DOCUMENTS

| | | | | |
|---|---|---|---|---|
| 2,763,907 | A | 9/1956 | Douglas | |
| RE26,126 | E * | 12/1966 | Buschow | A63B 49/14 285/285.1 |
| 5,381,849 | A * | 1/1995 | Fussnegger | B22D 19/04 164/102 |
| 8,905,118 | B2 * | 12/2014 | Charest | B22D 19/00 164/111 |
| 9,694,420 | B2 * | 7/2017 | Hu | B22D 19/02 |
| 2007/0271793 | A1 | 11/2007 | Mellis | |
| 2013/0174648 | A1 * | 7/2013 | Ward | B22D 17/2218 73/40 |
| 2014/0057125 | A1 | 2/2014 | Krzewinski | |
| 2015/0056470 | A1 * | 2/2015 | Aoyama | B22D 19/04 428/684 |
| 2017/0307001 | A1 * | 10/2017 | Nakashima | B22C 9/10 |

FOREIGN PATENT DOCUMENTS

| | | | | |
|---|---|---|---|---|
| JP | 58023563 A * | 2/1983 | | B22D 19/00 |

* cited by examiner

*Primary Examiner* — Kevin E Yoon
(74) *Attorney, Agent, or Firm* — Varnum LLP

(57) ABSTRACT

A method of over-molding a hybrid sub-assembly onto a base structure includes providing a mold for an over-molding process. The mold may comprise a lower mold tool, an upper mold tool, and a tube locator positioned on one of the upper mold tool or lower mold tool. A base structure formed of a first material is located into the tube locator. A mandrel tool is inserted into an opening in the base structure. The upper and lower mold tools are closed and clamped shut. A second material, such as a lighter weight or lower density material is heated to at least a semi-solid or slurry state. The semi-solid or slurry is injected into the mold to form a molded sub-assembly that is mechanically bonded to the base structure.

11 Claims, 12 Drawing Sheets

HYBRID PART OVER-MOLDING PROCESS AND ASSEMBLY

FIELD OF INVENTION

The present invention generally relates to a system and process for reducing the weight of parts through a redesigned over-molding process.

BACKGROUND

In automotive and other manufacturing, steel parts are commonly used to form frame and other base structure components of vehicles. Steel parts provide benefits over other materials due to the strength of steel and the low material costs compared to other materials. One drawback with steel, however, is that it weighs more than other materials, such as aluminum and magnesium.

Weight reduction in vehicles, especially automotive vehicles, provides many design and performance benefits. First, reducing a vehicle's weight will also increase its fuel efficiency. This is a major selling point for automotive vehicles as it provides a cost savings to consumers. Moreover, automotive manufactures are subject to strict fuel efficiency standards set by the government, and weight reduction plays a large role in meeting those standards. Second, weight reduction increases a vehicle's performance on the road without the need for adding in a larger engine. Third, weight reduction reduces wear and tear on the vehicle parts, such as wear on brake pads and components. These benefits, and others, have led many vehicle engineers and designers to seek even miniscule weight reductions, where available, in designing new vehicles.

In recent years, one idea for weight reduction has been to redesign heavy sub-assemblies and structures to include lower weight portions. For example, vehicles commonly include steel sub-assemblies, such as a steering wheel assembly or other assemblies, that may be redesigned to replace some portions of the assembly with portions composed of a lower weight material. Commonly this process is done by replacing steel parts that are traditionally welded, such as MIG welded, to the steel structure with new lower weight material parts, such as magnesium or aluminum. This is commonly accomplished by bolting the lower weight component to the steel structure. However, bolt on hybrid part designs have several deficiencies. First, the bolted connection may weaken or corrode, jeopardizing the connection with the steel structure. Further, bolting on numerous lower weight parts can be time consuming and costly.

Another idea for weight reduction that has been proposed is molding a lower weight material over a steel structure. However, past attempts at this type of over-molding have failed for various reasons. First over-molding requires precise timing, pressure, and technique in order to properly affix a second component to the steel base structure. Further, in the case of a hollow steel base structure, any variance in the pressure and timing of the molding may cause warping or deformation of the base structure, which can weaken the tension connection between the over-molded part and the base structure.

Accordingly, an improved process for forming a hybrid part through over-molding onto a base structure is needed in the art.

SUMMARY

A method of over-molding a hybrid sub-assembly onto a base structure is generally presented. A mold for over-molding is provided. The mold comprises a lower mold tool, an upper mold tool, and a tube locator positioned on one of the upper mold tool or lower mold tool. A base structure formed of a first material is located into the tube locator. A mandrel tool is inserted into an opening in the base structure. The upper and lower mold tools are closed and clamped shut. A second material, such as a lighter weight or lower density material, is heated to at least a semi-solid or slurry state. The semi-solid or slurry is injected into the mold to form a molded sub-assembly that is mechanically bonded to the base structure.

In an embodiment, the base structure is formed of steel. The second material is comprised of a material lighter than steel, such as magnesium, magnesium alloy, aluminum, or the like.

In an embodiment, the mandrel tool comprises a mandrel shaft and a collar. The mandrel shaft includes a tapered shaft. The collar is shaped to fit within an opening in the base structure with a clearance between the outer edge of the collar and an inner wall of the base structure. In use, the collar is inserted into the base structure opening and aligned with points of contact between the molded sub-assembly and the base structure. The mandrel shaft is then inserted into the collar to expand the collar into contact with an inner wall of the base structure.

In an embodiment, a method of redesigning a part assembly is provided. The method comprises providing a part assembly having a base structure and a sub-assembly connected to the base structure. The sub-assembly includes a plurality of components connected together, such as MIG welded together. The base structure and sub-assembly are formed of a first material. The method includes designing a mold to mold the sub assembly over the base structure. The mold includes an upper mold tool and a lower mold tool, and a tube locator positioned on one of the upper mold tool or lower mold tool. The tube locator is configured to hold the base structure therein during the molding process.

BRIEF DESCRIPTION OF THE DRAWINGS

The operation of the invention may be better understood by reference to the detailed description taken in connection with the following illustrations, wherein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

A hybrid part assembly 10 and over-molding process for forming a hybrid part assembly are generally presented. Traditionally, the part assembly 10 may comprise a base structure 12 and one or more sub-assemblies 14 connected to the base structure. One or more of the sub-assemblies 14 may be formed of a different material, such as a lower weight or lower density material, than the material of the base structure 12.

As shown in FIGS. 1-11 and described below, an example automotive assembly is provided to demonstrate the features and characteristics of the hybrid part assembly 10 and process for forming the hybrid part assembly. It will be appreciated that the automotive assembly described herein is one example of an embodiment of the invention, and the processes and design described herein may be applied to other assemblies to form a hybrid part assembly.

Figure 1:
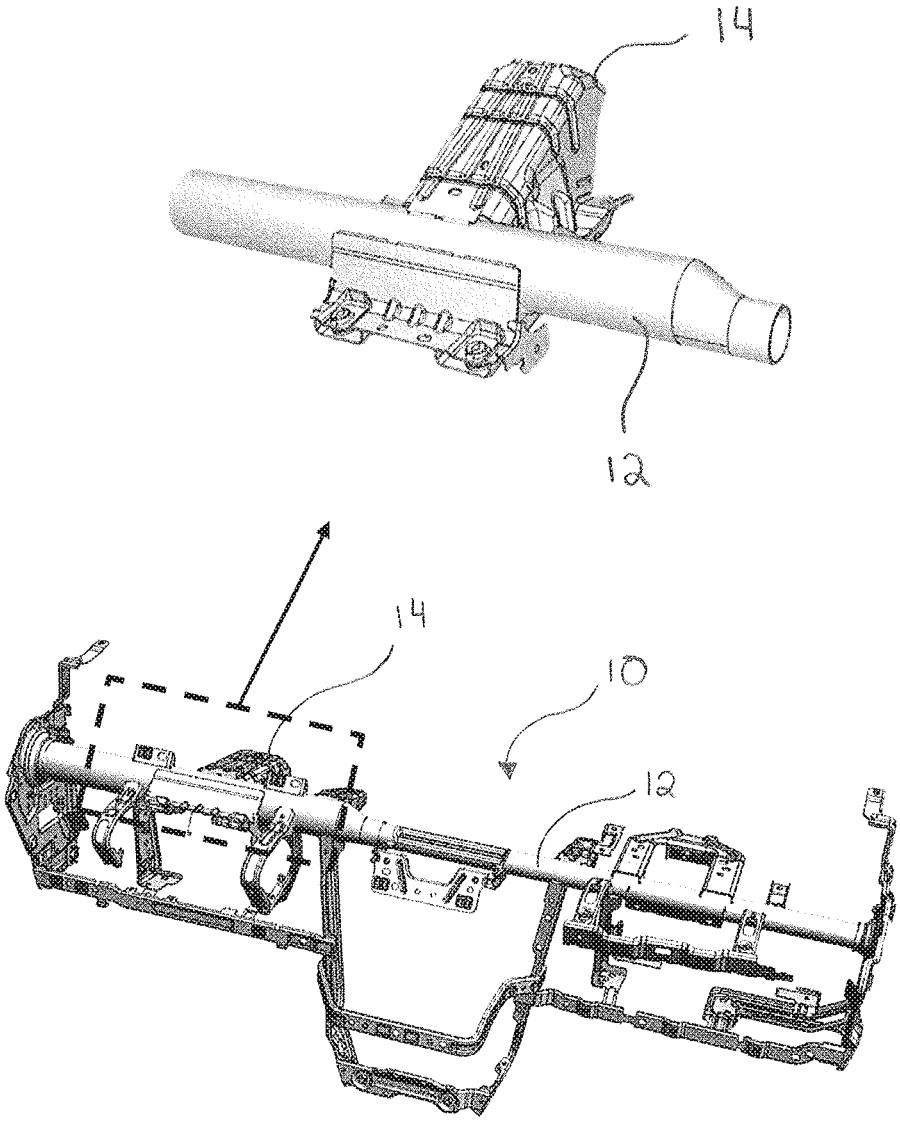
FIG. 1 PRIOR ART
FIG. 1 illustrates a perspective view of a traditional part assembly and connected sub-assembly.
Figure 2A:
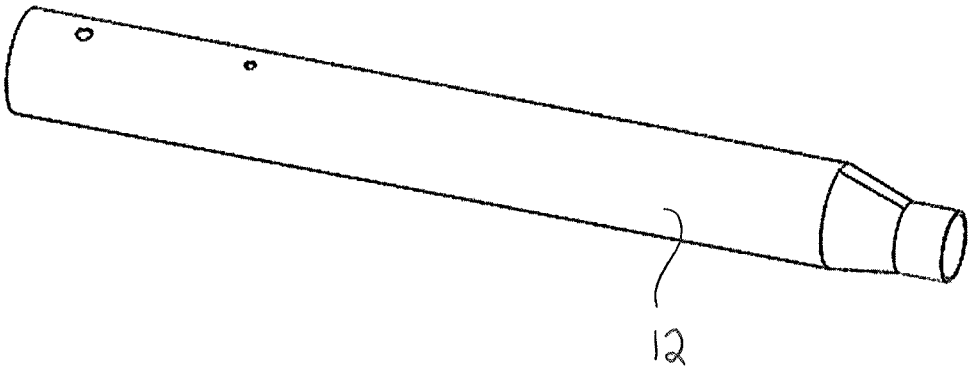
FIG. 2*a* illustrates a perspective view of a tubular base structure.
Figure 2B:
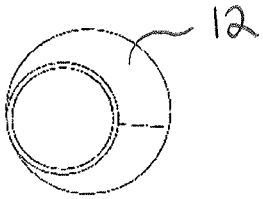
FIG. 2*b* illustrates a side view of a tubular base structure.

FIG. 1 illustrates a steering column mount bracket sub-assembly 14. The sub-assembly 14 may be connected to a tubular base structure 12. The base structure 12 may be formed of any appropriate or weldable material, such as steel. In an embodiment, the base structure may be formed of hot roll steel tubing having an approximate wall thickness of 2.0 mm. While the base structure 12 herein is shown and described as a tubular structure, it will be appreciated that the base structure 12 may consist of any appropriate cross-sectional shape, such as a triangle, square or rectangle, c-channel, I-beam, T-beam, plate, or the like.

Figure 3A:
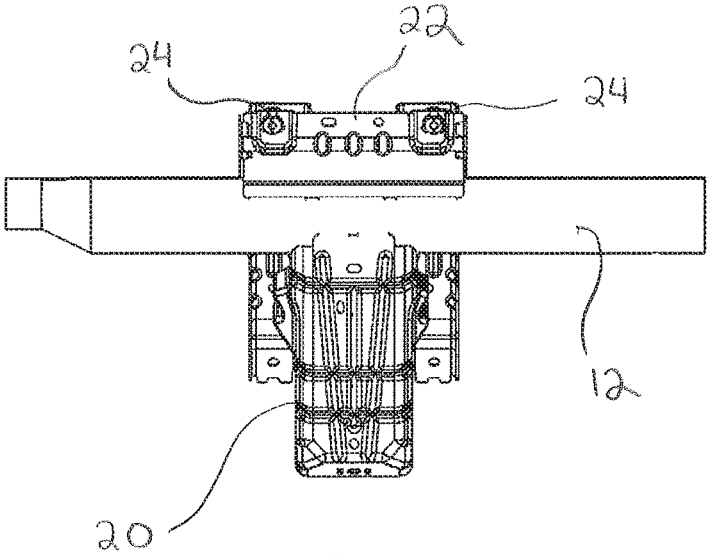
FIG. 3a PRIOR ART
FIG. 3*a* illustrates a top view of a traditional sub-assembly.
Figure 3B:
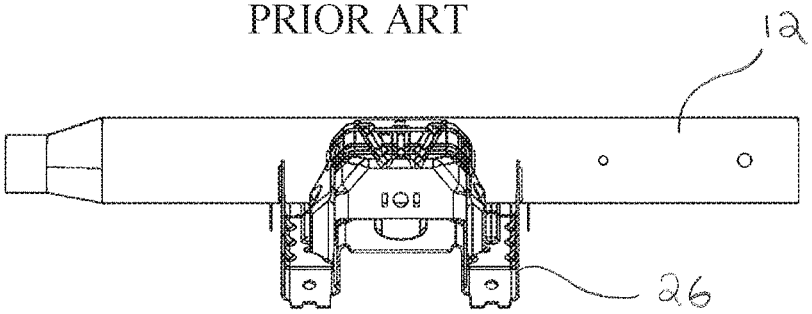
FIG. 3b PRIOR ART
FIG. 3*b* illustrates a rear view of a traditional sub-assembly
Figure 3C:
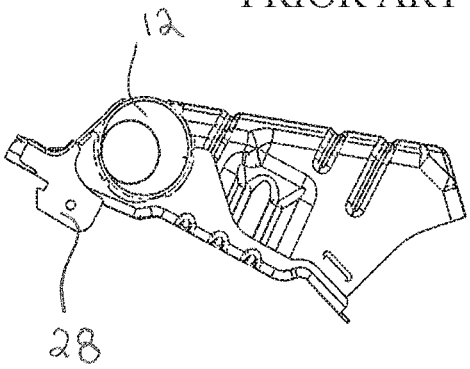
FIG. 3c PRIOR ART
FIG. 3*c* illustrates a side view of a traditional sub-assembly

In traditional designs, the sub-assembly 14 may be formed of numerous steel components. The components may be welded together individually, such as MIG welded, then welded to the steel base structure 12. The various components of the steering column mount bracket sub-assembly 14 are illustrated in FIGS. 3*a*-3*c*. These components include the fire wall bracket 20, reinforcement bracket 22, unthreaded weld spacers 24, steering mount bracket 26, and mounting brackets 28. In traditional designs, these components may be composed of different grades of steel, including hot roll steel, cold roll steel, and other grades and types, that are welded together to form the sub-assembly. As described herein, however, the present process removes the need for connecting numerous components in a sub-assembly 14 by creating the sub-assembly through a single over-mold.

Figure 4:
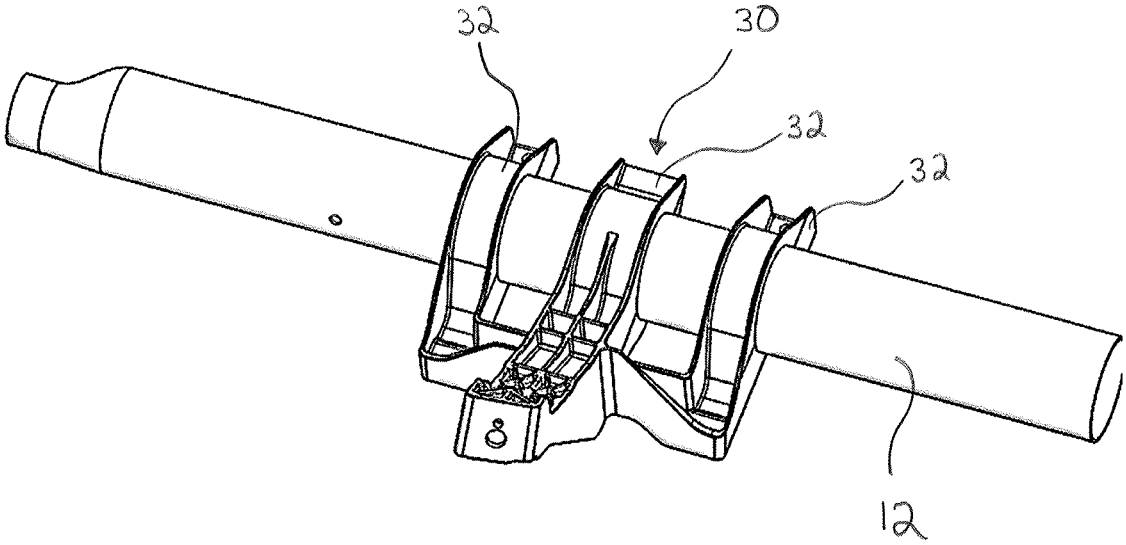
FIG. 4 illustrates a perspective view of a sub-assembly over-molded onto a base structure.
Figure 5:
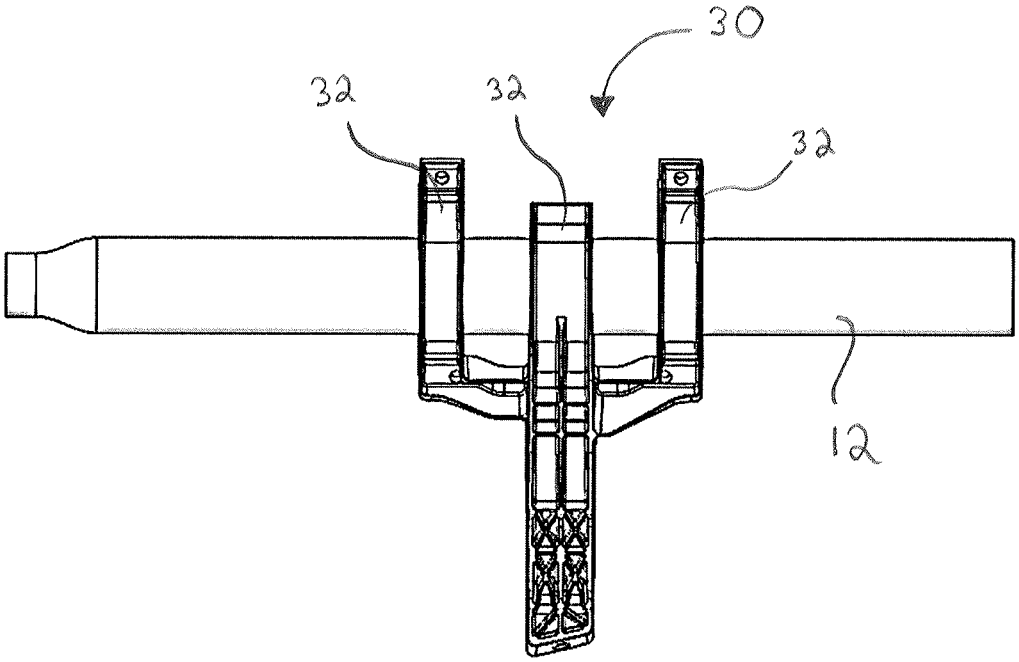
FIG. 5 illustrates a front view of a sub-assembly over-molded onto a base structure.

FIGS. 4 and 5 illustrates an over-mold sub-assembly 30 designed to replace the traditional steering column mount bracket sub-assembly 14. The over-mold sub-assembly 30 may be comprised of a lighter weight or lower density material than traditional hot roll steel. For example, the over-mold sub-assembly 30 may be comprised of magnesium or magnesium alloy. As shown, the over-mold sub-assembly 30 may be molded over the steel base structure 12 and may include all components of the traditional sub-assembly 14 into a single mold.

The over-molded sub-assembly 30 may be mechanically bonded to the steel base structure 12. For example, the sub-assembly 30 may include one or more arms 32 molded partially or completely around the steel base structure 12. The arms 32 may constrict the base structure 12 to hold the sub-assembly 30 in a tension fit with the base structure 12.

Figure 6:
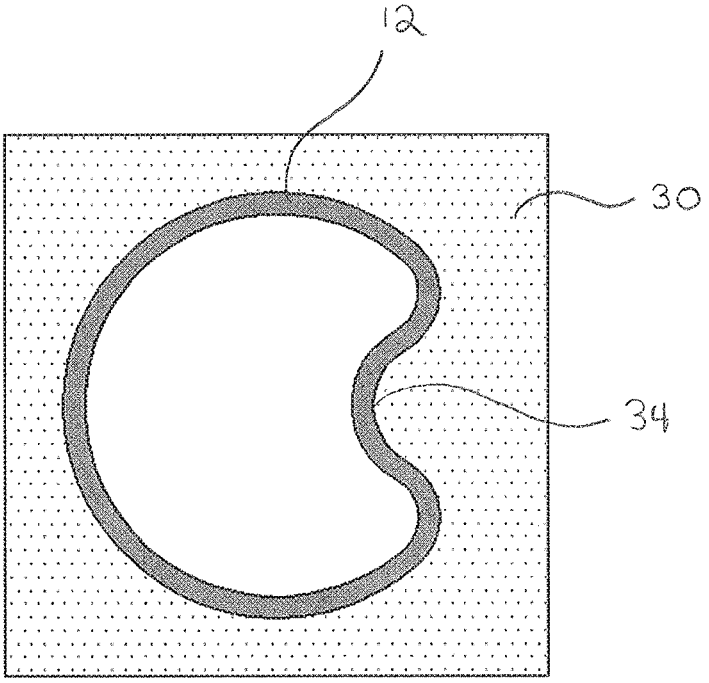
FIG. 6 PRIOR ART
FIG. 6 illustrates a base structure having a deformation therein.

The over-molding process may require specific precision and steps to avoid certain defects and unwanted deformations. For example, previous attempts at over-molding have failed due to resulting deformation of the steel base structure 12, as shown in FIG. 6. The base structure 12 shown includes a deformation 34 at the over-mold location. Without any constraints or regulation, the deformation 34 may be non-uniform and may weaken the connection between the sub-assembly 30 and the base structure 12. Another constraint on the over-molding process is injecting metal, such as magnesium alloy, into a mold with enough pressure and force to fill the mold without injuring or sticking to the mold itself, while still maintaining the desired connection with the base structure 12.

Figure 7:
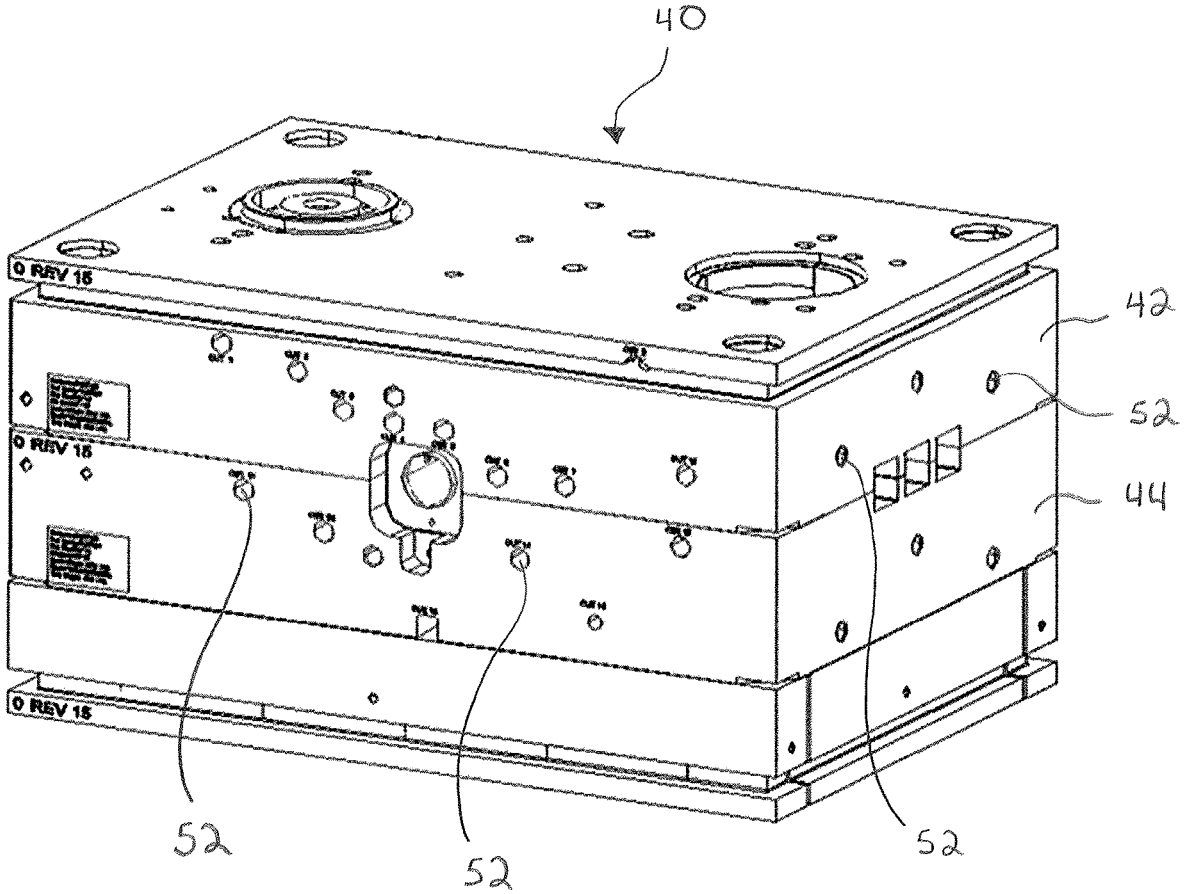
FIG. 7 illustrates a mold tool for an over-molding process.
Figure 8:
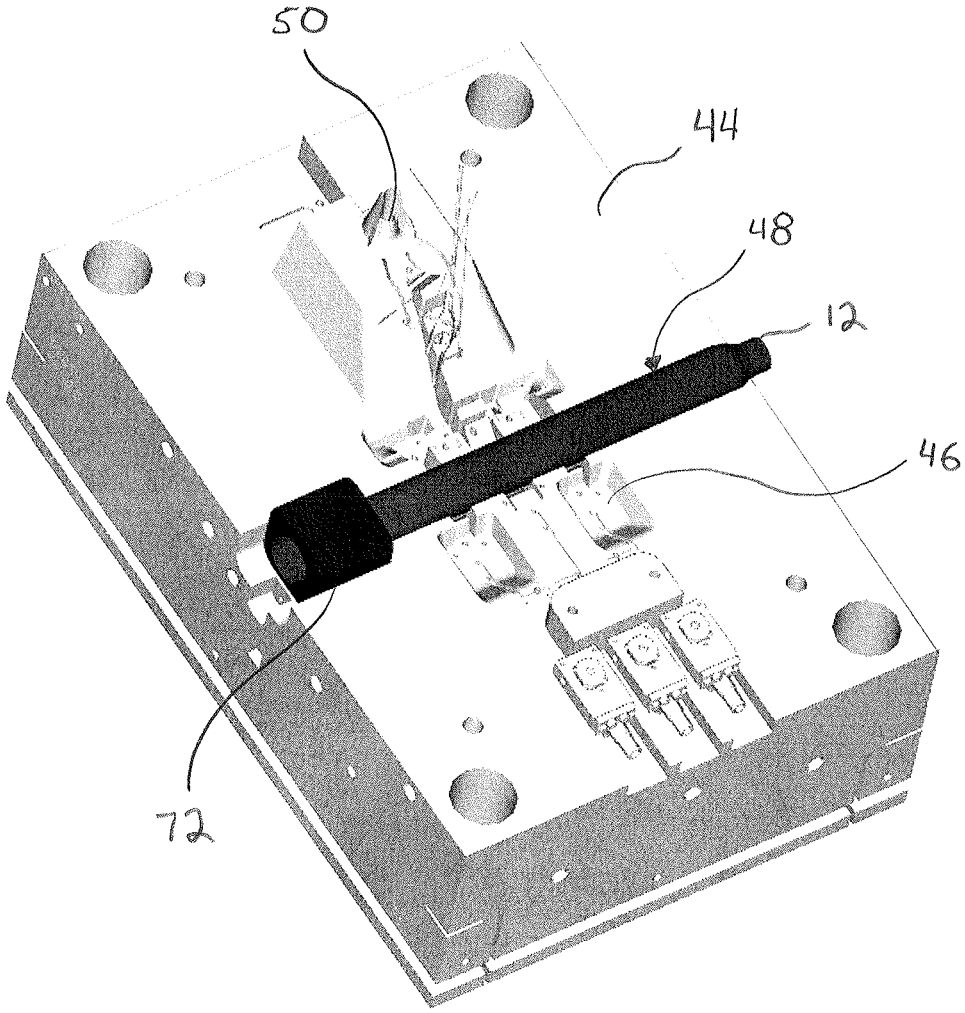
FIG. 8 illustrates a lower mold tool having a base structure inserted therein.

FIGS. 7-11 illustrate tools used in the over-molding process. As shown in FIG. 7, a mold 40 is provided. The mold 40 may include an upper tool 42 and a lower tool 44. The upper and lower tools 42, 44 may connect to form an interior mold cavity 46 designed to form the desired sub-assembly 30. The mold cavity 46 may include a tube locator 48. The tube locator 48 may comprise an opening in the mold cavity 46 configured to receive a base structure 12 therein to be over-molded by the mold 40.

The over-mold material may be injected into the mold 40 through and injection opening or sprue 50. The mold 40 may further include a plurality of cooling jets 52. The cooling jets 52 may comprise valve openings about the outer surface of the mold that extend to the interior of the mold 40. The cooling jets 52 may be connected to a water or air source to receive a cooling media to be applied to the over-mold material to quickly cool and form the over-mold.

Figure 9:
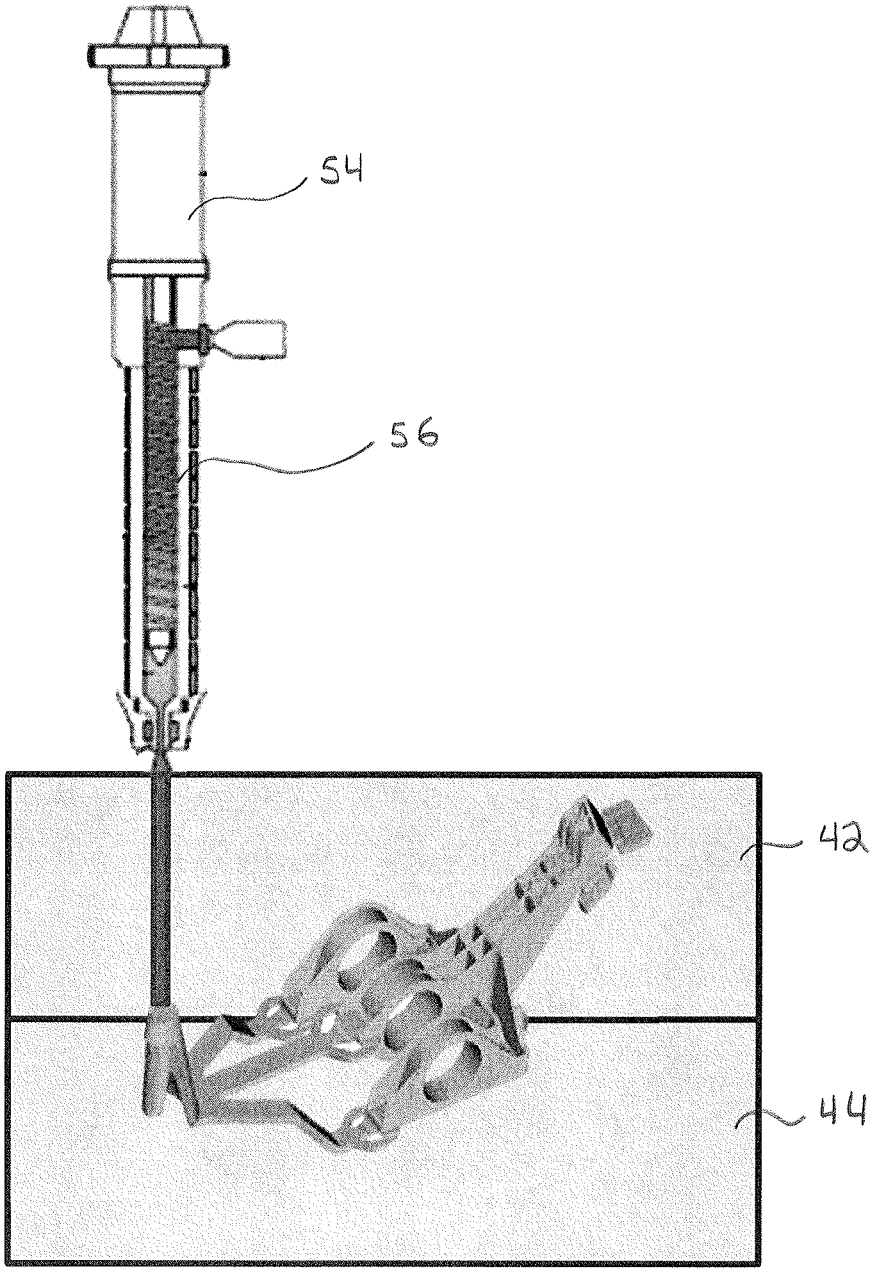
FIG. 9 illustrates a cross-sectional view of an over-mold injector connected to an over-mold tool.
Figure 10:
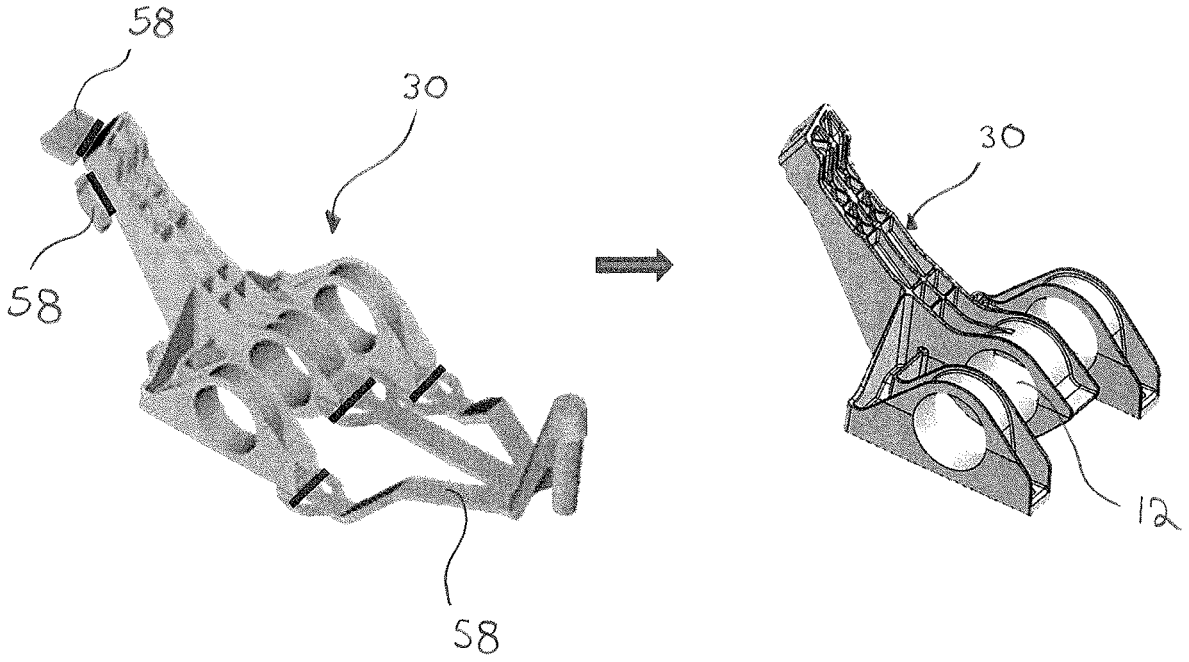
FIG. 10 illustrates a molded sub-assembly before and after excess material is removed.

The over-molding process may comprise high speed injection of a semi-solid over-mold metal, such as magnesium or a magnesium alloy, as illustrated in FIG. 9. The over-mold metal may begin at as a room temperature solid in chip form. The solid metal may be inserted into an injector 54, such as a hydraulic pressure injector. The solid metal may be heated to a semi-solid slurry state inside a barrel and screw 56 and injected into the mold 40 at the sprue 50. The semi-solid slurry may be pressurized to fill the entire mold before the cooling jets 52 are activated to quickly cool the over-molded sub-assembly 30. The upper and lower mold tools 42, 44 may then be separated and the sub-assembly 30 removed. Excess over-mold material 58 may then be removed from the molded sub-assembly, as shown in FIG. 10, to complete the finished sub-assembly 30.

During the over-molding process, parameters related to injection of the over-mold metal are highly regulated to ensure that the process yields a fully molded part without deforming the surface of the base structure 12 or injuring the mold 40. For example, the temperature of the semi-solid or molten metal may be regulated to provide enough liquidity for desired flow without being too high to damage or chemically bond with the mold. Injection flow velocity may be regulated to be above minimum velocity to avoid material cooling before it reaches outer regions of the mold cavity 46. The injection velocity may be further regulated to stay below a maximum velocity to avoid deformation of the base structure 12. Timing is also critical to ensure a fully formed part and prevent damage to the mold 40. The timing of the injection process and cool time may be specifically set, depending on the assembly design, to ensure that the mold is fully filled and then immediately cooled to form the desired sub-assembly 30.

Figure 11:
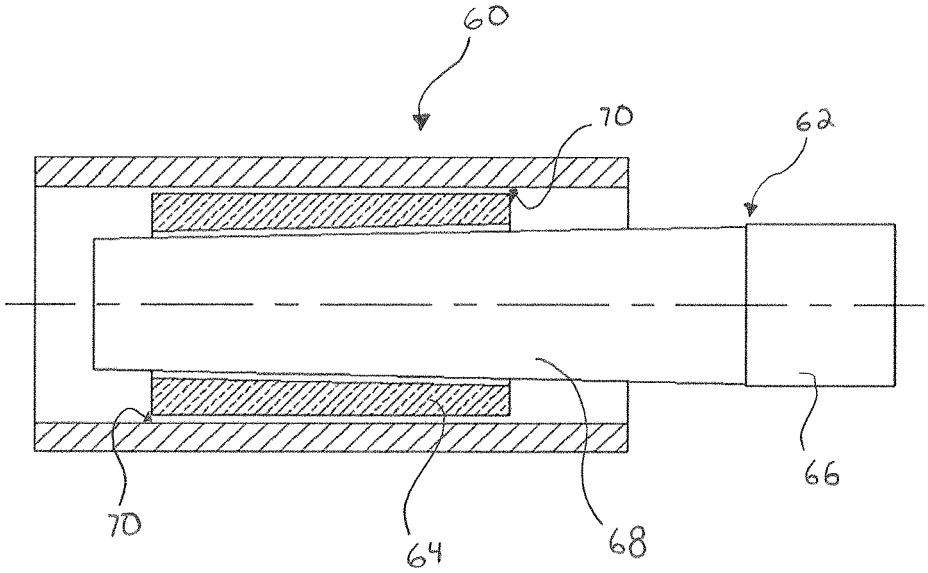
FIG. 11 illustrates a cross-sectional view of a mandrel tool.
Figure 12:
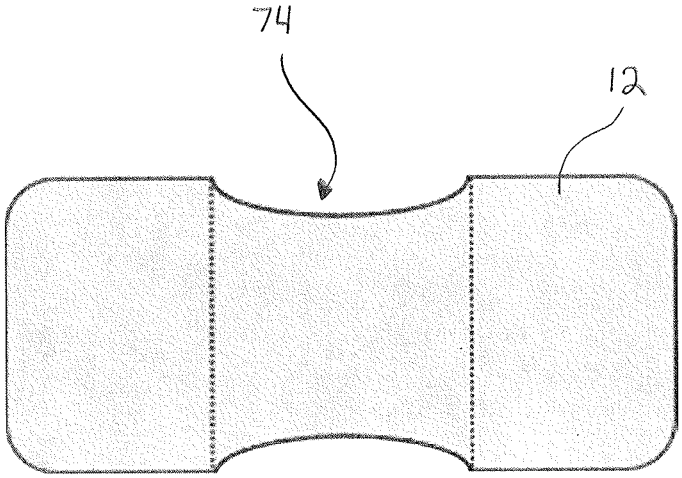
FIG. 12 illustrates a base structure having a uniform deformation caused by an over-molding process.

Even with the above processes parameters and safeguards in place, prior over-molding processes have failed to prevent unwanted deformation of the base structure 12. To ensure the rigidity of the base structure 12 and prevent deformation, a mandrel tool 60 may be used during the over-molding process. As shown in FIG. 11, the mandrel tool 60 may comprise a mandrel shaft 62 and a collar 64. The mandrel shaft 62 may include a first end 66 and a tapered shaft 68 extending away from the first end 66. The mandrel collar 64 may comprise a tubular portion sized and shaped to receive the mandrel shaft 62 therein. The mandrel collar 64 may further be sized and shaped to fit within the tubular opening of the base structure 12. A clearance 70 may be provided between the collar and the inner wall of the base structure 12 to allow for insertion of the collar 64 into the base structure opening. It will be appreciated that the collar 64 may be any appropriate shape to correspond with the shape of a give base structure 12.

Prior to the molding process, the mandrel tool 60 may be inserted into the base structure 12. The collar 64 may be long enough to provide reinforcement behind all points of contact between the over-molded sub-assembly 30 and the base structure 12. The collar 64 may be aligned with the points of contact, then the mandrel shaft 62 inserted into the opening of the base structure 12 and through the collar 64. The tapered shaft 68 may expand the collar 64 to contact the inner wall of the base structure 12 to provide reinforcement and backup pressure against any unwanted deformation. During the mold process, the over-molded sub-assembly 30 may apply pressure to the outer wall of the base structure 12. The mandrel tool 60 may be designed to provide some give and have a tolerance that allows for a slight deformation 74 of the outer wall of the base structure 12. This deformation 74 may be generally uniform around the outer wall of the base structure 12 to help provide a strong mechanical bond between the sub-assembly 30 and the base structure 12. Once the molding process is complete, the mandrel tool 60 may be removed by removing the mandrel shaft 62 then allowing the collar 64 to slide out of the opening in the base structure 12.

In use, an existing part assembly 10 may be redesigned for weight reduction purposes by designing over-mold sub-assemblies 30 of a lighter weight or lower density to replace existing sub-assemblies 14. A mold 40 having an upper tool 42 and a lower tool 44 may be provided. The upper and lower tools 42, 44 may form a mold cavity 46 that replicates a sub-assembly 14 that previously was formed by numerous higher weight or higher density materials.

In production, a base structure 12 may be placed into a tube locator 48 within the mold cavity 46. A locator block 72 may be placed over the base structure 12 to ensure proper placement and location of the base structure 12 within the mold 40. A mandrel tool 60 may then be inserted into the base structure 12 as described above, by aligning the collar 64 with the over-mold contact points and inserting the mandrel shaft 62 into the collar 64 to expand the collar 64 into contact with the inner wall of the base structure. The lower and upper mold tools 42, 44 may then be closed and clamped shut. Solid lower weight or lower density metal, such as magnesium or a magnesium alloy, may be added to an injector, such as a hydraulic pressure injector. The solid metal flakes or chips may be heated within the barrel and screw 56 and injected into the mold 40 through the sprue 50. The injection temperature, velocity, and pressure may be regulated to ensure that a fully formed sub-assembly 30 is formed while avoiding damage to the mold or base structure 12. Once the sub-assembly is molded, water jets 52 may be activated to cool the part for a desired amount of time. The upper and lower mold tools 42, 44 may then be separated and the assembly may be removed from the mold 40. The mandrel tool 60 may be removed from the base structure by removing the mandrel shaft 62 from the collar 64 and allowing the collar 64 to slide out of the base structure 12.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

Having thus described the invention, we claim:

1. A method of over-molding a hybrid sub-assembly onto a base structure comprising:

providing a mold comprising a lower mold tool, an upper mold tool, and a tube locator positioned on one of the upper mold tool or lower mold tool;

locating a base structure into the tube locator, wherein the base structure is formed of a first material;

inserting a mandrel tool into an opening in the base structure;

closing the upper and lower mold tools;

heating a second material to at least a semi-solid state, wherein the second material is different from the first material and has a lower density than the first material;

injecting said second material into the mold; and wherein the injected material forms a molded sub-assembly having a mechanical bond to the base structure; and wherein the mandrel is spaced away from the base structure to allow for partial deformation of the base structure to create the mechanical bond between the molded sub-assembly and the base structure.

2. The method of claim 1, wherein the base structure is formed of steel.

3. The method of claim 1, wherein the second material is magnesium or a magnesium alloy.

4. The method of claim 1, wherein the mandrel tool comprises a collar and a mandrel shaft.

5. The method of claim 4, wherein the mandrel shaft includes a tapered shaft.

6. The method of claim 4 further comprising the step of:

inserting the collar into the opening in the base structure;

aligning the collar with points of contact between the molded sub-assembly and the base structure; and inserting the mandrel shaft into the collar to expand the collar into contact with an inner wall of the base structure.

7. The method of claim 4 further comprising the steps of:

removing the mandrel shaft from the base structure; and removing the collar from the base structure.

8. The method of claim 1, wherein the base structure is hollow and has a cylindrical shape.

9. The method of claim 1 further comprising the step of connecting a tube block to the base structure before inserting the base structure into the tube locator.

10. The method of claim 1 further comprising the step of activating water jets to cool the molded sub-assembly.

11. The method of claim 1, wherein the temperature of the second material, the force applied during injection of the second material into the mold, and the speed of injection are held within upper and lower constraints to ensure creation of a fully molded part while preventing damage to the mold or base structure.

* * * * *